US009756436B2

(12) United States Patent
Park et al.

(10) Patent No.: US 9,756,436 B2
(45) Date of Patent: Sep. 5, 2017

(54) TERMINAL TO CONTROL AUDIO OUTPUT PATH AND METHOD FOR CONTROLLING AUDIO OUTPUT PATH BETWEEN TERMINALS

(71) Applicant: Pantech Inc., Seoul (KR)

(72) Inventors: Jae Sung Park, Seoul (KR); Hyae Ran Kim, Seoul (KR)

(73) Assignee: Pantech Inc., Seoul (KR)

( * ) Notice: Subject to any disclaimer, the term of this patent is extended or adjusted under 35 U.S.C. 154(b) by 104 days.

(21) Appl. No.: 14/225,209

(22) Filed: Mar. 25, 2014

(65) Prior Publication Data

US 2014/0294194 A1 Oct. 2, 2014

(30) Foreign Application Priority Data

Mar. 29, 2013 (KR) ..... 10-2013-0034314

(51) Int. Cl.
*H04R 27/00* (2006.01)

(52) U.S. Cl.
CPC ..... *H04R 27/00* (2013.01); *H04R 2227/003* (2013.01); *H04R 2227/005* (2013.01)

(58) Field of Classification Search
None
See application file for complete search history.

(56) References Cited

U.S. PATENT DOCUMENTS 8,779,265 B1 * 7/2014 Gottlieb ..... G10H 1/0033 84/600
8,918,822 B2 * 12/2014 Varoglu ..... H04N 21/4122 725/141

FOREIGN PATENT DOCUMENTS

KR 10-2001-0041588 5/2001
KR 10-2007-0070528 7/2007

OTHER PUBLICATIONS

"AirPlay Overview", Sep. 19, 2012, Apple Inc., p. 5-15.*

* cited by examiner

*Primary Examiner* — Curtis Kuntz
*Assistant Examiner* — Kenny Truong
(74) *Attorney, Agent, or Firm* — H.C. Park & Associates, PLC

(57) ABSTRACT

According to an exemplary embodiment of the present invention, a terminal and a method for controlling an audio output path is provided. The terminal includes: an audio output path setting unit to determine an audio output path for one or more audio data when one or more audio event occurs; an audio output unit to output a first audio data in a first audio output path; and a data communication unit to transmit one or more audio data other than the first audio data to external terminal(s) by setting a second audio output path.

16 Claims, 11 Drawing Sheets

TERMINAL TO CONTROL AUDIO OUTPUT PATH AND METHOD FOR CONTROLLING AUDIO OUTPUT PATH BETWEEN TERMINALS

CROSS-REFERENCE TO RELATED APPLICATION

This application claims priority from and benefit under 35 U.S.C. §119(a) of Korean Patent Application No. 10-2013-0034314, filed on Mar. 29, 2013, in the Korean Intellectual Property Office, which is hereby incorporated by reference for all purpose as if fully set forth herein.

BACKGROUND

Field

The present disclosure relates to a terminal controlling an audio output path and a method for controlling an audio output path between terminals, and more particularly, to a terminal controlling an audio output path and a method for controlling an audio output path between terminals which selectively control an audio output path between terminals connected to be communicable with each other to output an audio therein.

Discussion of Background

Recently, wireless communication technologies are widely used not only in a communication field but also in all the industry fields in accordance with the developments of communication technology. Accordingly, various services such as a voice phone call, data transmission, and Internet services are provided based on wireless networks. Representative wireless communication technologies that are based on such wireless communication networks include, for example, Bluetooth and Wireless Fidelity (WiFi). Particularly, wireless communication systems such as WiFi Display (WiDi) and other similar systems that allow terminal data to be shared have developed. The WiDi communication system is a technology enabling a source device to transmit video data and audio data to a sink device and has an advantage of allowing a motion picture reproduced by a smartphone to be viewable through a television set.

An audio output structure generated through a plurality of contents in terminals according to conventional WiDi communication technology is described below.

Referring to FIG. 1, when a plurality of applications 11, 12, and 13 are simultaneously executed, audio data relating to contents provided by the applications 11, 12, and 13 have mutually-different forms. Such audio data is supplied to an audio data acquiring unit 30.

An audio output path setting unit 20 sets a path in which such audio data is output in advance. For example, if a music player application is to be executed, audio data relating to music is preset to be output to a speaker by the audio output path setting unit 20.

The audio data is then decoded and mixed through an audio mixer 40 to be converted into an audio. An audio driver 50 transmits the audio in the audio output path determined by the audio output path setting unit 20.

However, even when first, second, and third terminals 61, 62, and 63 are set as output terminals, the audio output path setting unit 20 sets the output path so that all audios are output only through one output path that is currently connected. For example, in a case where a smartphone is connected to a television set through WiDi, and a motion picture stored in the smartphone is viewed through the television set, the audio of the motion picture output from the smartphone is output through a speaker of the television set. At this time, even if the user wants to listen to music through the smartphone, the music is output through the speaker of the television set. Accordingly, only an audio that is output last may be reproduced, or two or more audios may be output while being mixed with each other. In other words, according to a conventional technology, even when several terminals capable of outputting audio are connected to each other, different audios are set to be output through only one path, which creates difficulty for a user to simultaneously listen to a plurality of audios.

SUMMARY

Exemplary embodiments of the present invention provide a terminal and a method to control an audio output path.

Exemplary embodiments of the present invention provide a terminal and a method to control an audio output path when several terminals capable of outputting audio are communicable with each other.

Additional features of the invention will be set forth in the description which follow, and in part will be apparent from the description, or may be learned by practice of the invention.

An exemplary embodiment of the present invention provides a source terminal to control an audio output path, the source terminal comprising an event executing unit to execute an audio event; an audio data acquiring unit to acquire an audio data corresponding to the audio event, the audio data having a first audio output path; and an audio output path setting unit to set a second audio output path of the audio data, the second audio output path being different from the first audio output path.

An exemplary embodiment of the present invention provides a method for controlling an audio output path, the method comprising: executing an audio event; acquiring an audio data corresponding to the audio event, the audio data having a first output path; and setting a second audio output path of the audio data, the second audio output path being different from the first audio output path.

An exemplary embodiment of the present invention provides a source terminal to control an audio output path, the source terminal comprising: an event executing unit to execute an audio event; an audio data acquiring unit to acquire an audio data corresponding to the audio event; an audio processing unit to select a terminal to output audio from the source terminal and one or more sink terminal(s) connected to the source terminal; and an audio output path setting unit to set an audio output path of the audio data to the selected terminal.

An exemplary embodiment of the present invention provides a method for controlling an audio output path, the method comprising: executing an audio event; acquiring an audio data corresponding to the audio event; selecting a terminal to output audio from a source terminal and one or more sink terminal(s) connected to the source terminal; and setting an audio output path of the audio data to the selected terminal.

It is to be understood that both the foregoing general description and the following detailed description are exemplary and explanatory and are intended to provide further explanation of the invention as claimed. Other features and aspects will be apparent from the following detailed description, the drawings and the claims.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. Furthermore, the use of the terms a, an, etc. does not denote a limitation of quantity, but rather denotes the presence of at least one of the referenced item. The use of the terms "first", "second", and the like does not imply any particular order, but they are included to identify individual elements. Moreover, the use of the terms first, second, etc. does not denote any order or importance, but rather the terms first, second, etc. are used to distinguish one element from another. It will be further understood that the terms "comprises" and/or "comprising", or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof. It will be understood that for the purposes of this disclosure, "at least one of" will be interpreted to mean any combination the enumerated elements following the respective language, including combination of multiples of the enumerated elements. For example, "at least one of X, Y, and Z" will be construed to mean X only, Y only, Z only, or any combination of two or more items X, Y, and Z (e.g. XYZ, XZ, XZZ, YZ, X).

Hereinafter, a terminal controlling an audio output path and a method for controlling an audio output path between terminals according to an exemplary embodiment of the present invention will be described in detail with reference to the drawings. Further, as used herein, each of the units described may be combined with other units, or operations may be split from the described units. Each unit may be hardware, software, firmware, or a mixture thereof. For example, each unit may be implemented by an application specific integrated circuit, however, aspects are not limited thereto.

In the description presented below, an audio represents a sound or a sound source of an audio frequency band.

Figure 1:
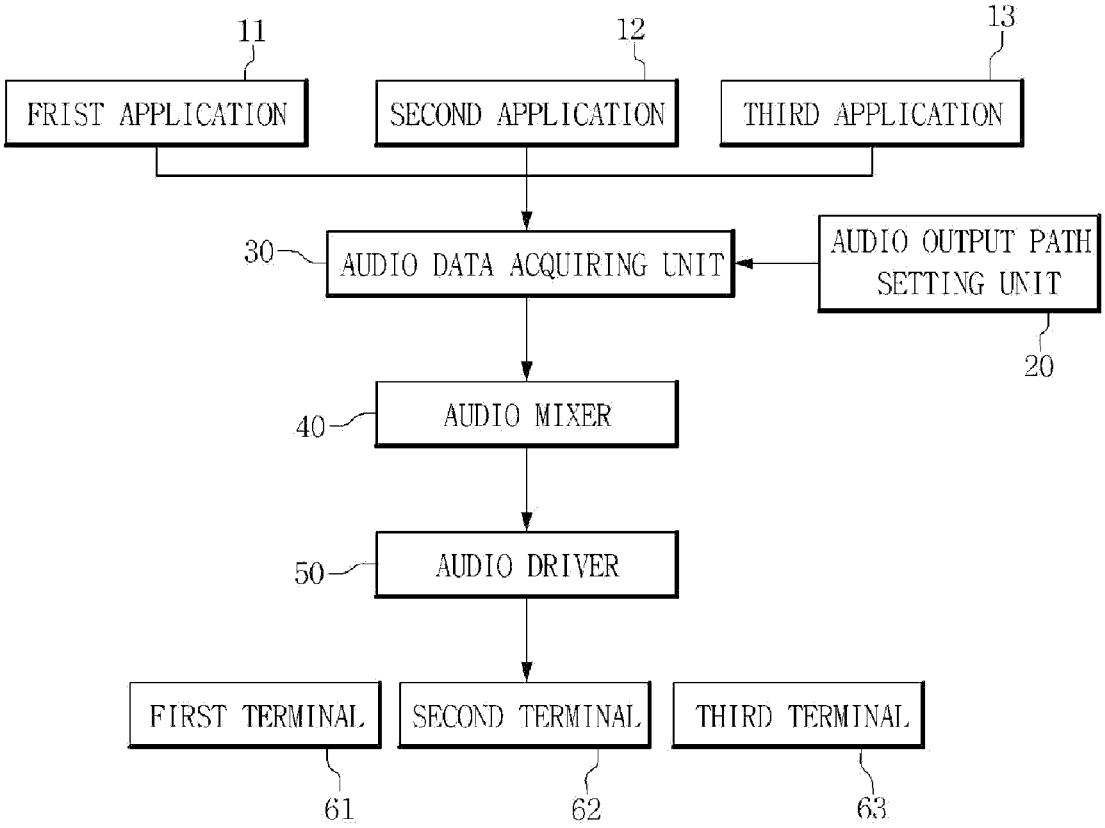
FIG. 1 (Related Art)
FIG. 1 is a structural diagram that illustrates an audio output path in a terminal according to the related art.
Figure 2:
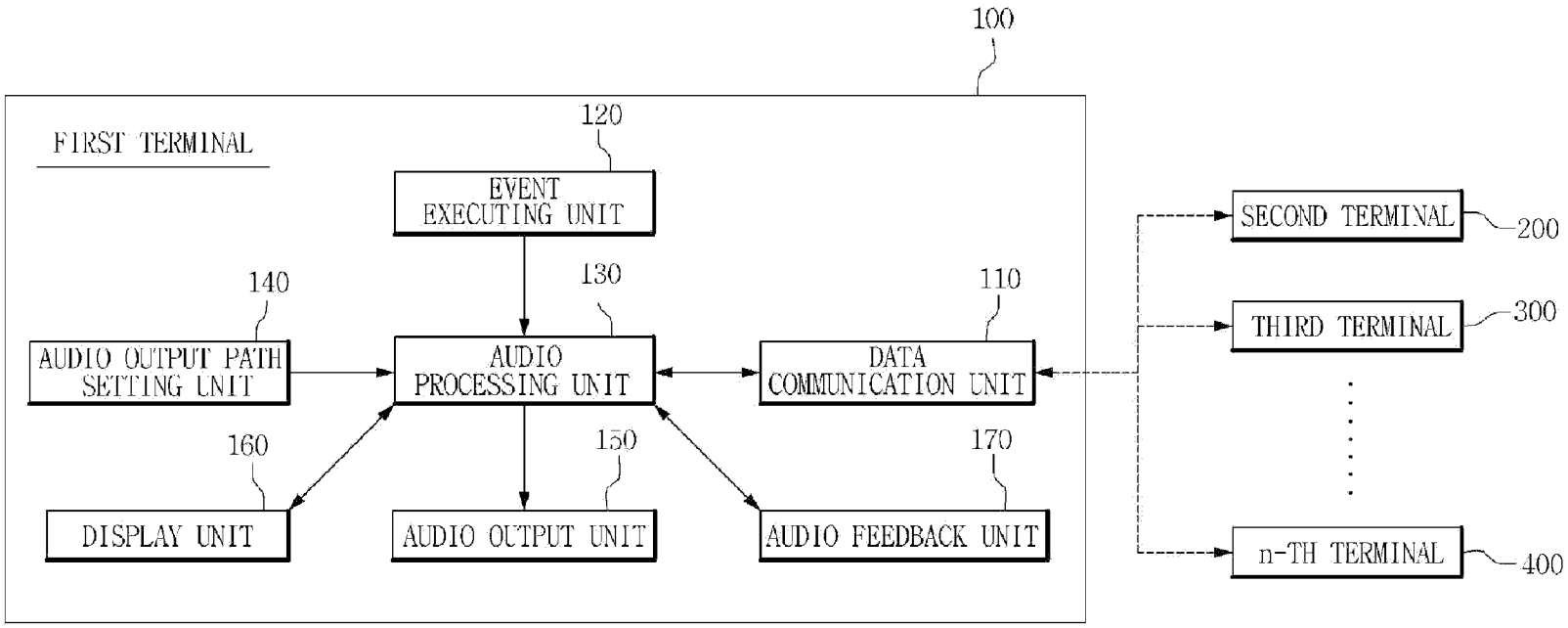
FIG. 2 is a structural diagram of a terminal according to an exemplary embodiment of the present invention.

Referring to FIG. 2, a first terminal 100 according to an exemplary embodiment of the present disclosure includes a data communication unit 110, an event executing unit 120, an audio processing unit 130, an audio output path setting unit 140, an audio output unit 150, a display unit 160, and an audio feedback unit 170. The data communication unit 110 enables the first terminal 100, i.e., a source terminal, to transmit or receive data to or from other terminals, i.e., sink terminals, such as a second terminal 200, a third terminal 300, . . . , an n-th terminal 400. For example, an image, a video, an audio, a file, etc. of the first terminal 100 can be transmitted to other terminals by the data communication unit 110. In addition, the data communication unit 110 may receive audio output information of other terminals. The audio output information may represent overall specifications relating to the output of an audio, such as whether an audio is currently being output, the type of an audio codec, and audio output performance of other terminals. The data communication unit 110 may perform communication in a wired or wireless manner and may perform communication using a wireless communication system such as Bluetooth, Wireless Fidelity (WiFi), WiFi Direct, WiFi Display (WiDi), or near field communication (NFC). However, the data communication unit 110 may perform communication using a WiFi Direct system or a WiFi Display system. WiFi Direct is a communication system enabling data between devices to be shared through WiFi. Particularly, WiFi Direct has a feature that may allow a large amount of data to be transmitted for a longer distance than that of a Bluetooth system. In addition, WiFi Display is a transmission system based on WiFi enabling a source terminal to transmit video data and audio data to the sink terminal.

The event executing unit 120 executes an event that occurs inside the first terminal 100. The event may be event in accordance with a user input, a default setting, an automatic operation of an application, and/or the like. For example, a specific application or a specific content may be executed or reproduced in accordance with a user input or automatically. If the application to be executed is an application used for reproducing music or a motion picture, a music reproduction event or a motion picture reproduction event may be generated. Examples of the event described in an exemplary embodiment of the present invention may include any of various events including audio such as a motion picture, music, a video clip, and the like.

The audio processing unit 130 serves to process an audio in accordance with an audio output event received from the event executing unit 120. The audio processing unit 130 receives audio data in accordance with an audio output event and selects a terminal that outputs the audio based on the audio output information of each terminal received from the data communication unit 110. Then, the audio data is delivered in an audio output path to the selected terminal.

The audio output path setting unit 140 serves to set an output path of audio data acquired by the audio processing unit 130 in advance. Generally, a path in which the audio data is output is designated in a predetermined route. For example, the route of a music file or a sound file of a motion picture may be designated to be output to a speaker of the source terminal such as the first terminal 100. If the music or the motion picture is to be outputted from a sink terminal through wireless communication with the source terminal, the audio output path setting unit 140 may set the route such that the music file or the sound file of the motion picture is output to the speaker of a sink terminal such as the second terminal 200, third terminal 300, or nth terminal 400.

In a case where the audio processing unit 130 designates a path such that an audio is output by the first terminal 100, the audio output unit 150 receives the audio from the audio processing unit 130 and outputs the audio. The audio output unit 150 includes a component capable of reproducing sound such as a speaker or a headphone.

The display unit 160 displays an event that has occurred. The display unit 160 may present a pop-up window to allow a user to select a terminal to output the audio in accordance with a command of the audio processing unit 130. For example, the display unit 160 may display a list including the source terminal and sink terminals available to output audio.

In a case where the audio output path is designated as a sink terminal such as the second terminal 200, third terminal 300 etc., the audio feedback unit 170 provides the audio output state of the designated terminal to the audio processing unit 130 of the first terminal 100. For example, the audio output path may be designated as the second terminal 200, in which case the audio feedback unit 170 may provide the audio output state of the second terminal 200 to the audio processing unit 130 of the first terminal 100. The audio feedback unit 170 receives the audio output state of the designated terminal from the data communication unit 110. If an error occurs in the audio output state of the designated terminal, for example, if the speaker of the designated terminal is broken and the audio may not be output, or an error occurs in the audio codec of the designated terminal and audio may not be clearly reproduced, the audio feedback unit 170 notifies the audio processing unit 130 of the occurrence of the error. The error may be communicated from the designated terminal to the first terminal 100 through the data communication unit 110 in the received audio output information.

The internal configuration of the first terminal 100 described above may be included in other terminals such as the second terminal 200, the third terminal 300, to the n-th terminal 400. Examples of the terminal or device described in an exemplary embodiment of the present invention may include any of various communicable electronic devices such as a headset, a television set, a computer, a tablet PC, a PDA, a mobile terminal, an audio device, a car or home stereo, and the like.

Figure 3:
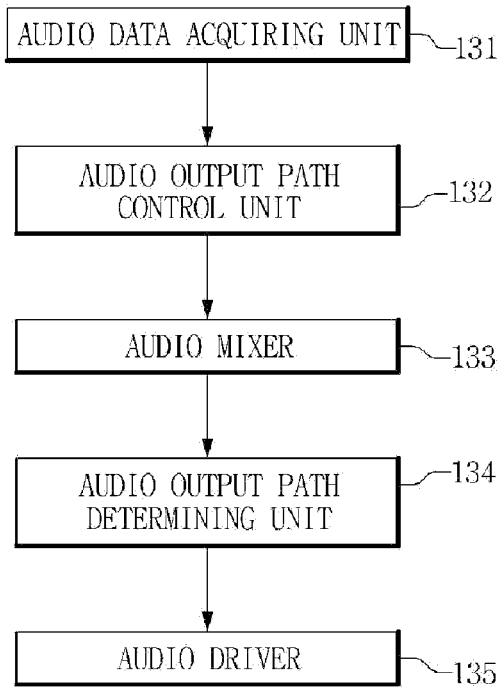
FIG. 3 is a structural diagram of an audio processing unit according to an exemplary embodiment of the present invention.

FIG. 3 is a structural diagram of an audio processing unit according to an exemplary embodiment of the present invention. With reference to FIG. 3, hereinafter, the configuration of the audio processing unit 130 according to an exemplary embodiment of the present invention for controlling an audio output path will be described in detail. Although aspects are described as being of the audio processing unit 130, aspects need not be limited thereto such that the audio data acquiring unit 131, the audio output path control unit 132, the audio mixer 133, the audio output path determining unit 134, and the audio driver 135 may be included separately or within other components or units.

As illustrated in FIG. 3, the audio processing unit 130 in FIG. 2 comprises an audio data acquiring unit 131, an audio output path control unit 132, an audio mixer 133, an audio output path determining unit 134, and an audio driver 135. Although aspects are described as being of the audio processing unit 130, aspects need not be limited thereto such that the audio data acquiring unit 131, the audio output path control unit 132, the audio mixer 133, the audio output path determining unit 134, and the audio driver 135 may be included separately or within other components or units.

When an audio output event occurs in the first terminal 100, an audio data acquiring unit 131 acquires audio data from the event executing unit 120 in FIG. 2. At this time, the audio data acquiring unit 131 may acquire the audio data from audio hardware through an audio hardware abstraction layer (HAL).

An audio output path control unit 132 controls the output path of the audio data that is preset by the audio output path setting unit 140 in FIG. 2. For example, in a case where the output path of a music file is preset to the second terminal 200, the audio output path control unit 132 may reset the audio output path and/or control the audio data to be output to terminals other than the second terminal 200.

For the audio output path control unit 132 to change the terminal to output the audio data, when an audio output event occurs, the audio output path control unit 132 receives the acquired audio data and searches for a terminal capable of outputting an audio. Terminals that are search targets include the first terminal 100 and the other terminals that are connected to the first terminal 100 to be communicable with each other. Then, the audio output path control unit 132 selects a terminal capable of outputting the audio based on the audio output information of the first terminal 100 and the other terminals.

The selection of the output path by the audio output path control unit 132 may be made in accordance with a user input or may be automatically made by a predetermined internal process set based on the audio output information. For example, when an audio output event relating to music occurs in a state in which the first terminal 100 and the second terminal 200 are connected to be communicable with each other, and a sound relating to a motion picture is reproduced in the second terminal 200, the audio output path control unit 132 may display the first terminal 100 and the second terminal 200 through the display unit 160 as terminals capable of outputting an audio to the user. At this time, considering that the sound relating to a motion picture is output in the second terminal 200, the user may select the first terminal 100 for the audio output event relating to music. In the above-described example, the audio output path control unit 132 may automatically select the first terminal 100 where there is no audio output. Furthermore, the audio output path control unit 132 may designate an audio output path in accordance with a preset priority level. In such a case, the priority level may be designated by a user input. For example, the priority level may be set such that the second terminal 200 is of a higher priority than the first terminal 100 to output music related to an audio event, but, because the second terminal 200 is outputting the sound related to the motion picture, the audio output path control unit 132 selects or designates an audio output path to the first terminal 100 to output the music related to the audio event.

In addition, the audio output path control unit 132 may guide a user's input by providing an audio control interface through the display unit. The audio control interface may be provided to guide a user to make input relating to the audio output path or an input relating to the setting of priority levels of audio output paths. The audio control interface may display a list of terminals capable of outputting audios, and the user may designate an output path by selecting any one of the terminals from the list or may designate priority levels in advance by designating a plurality of terminals in a specific order. The specific order may be, for example, in accordance with preferences, current audio output, proximity, and the like.

Furthermore, in a case where a sink terminal is designated as an audio output target, the audio output path control unit 132 may designate a decoding position of audio data based on the audio output information of the designated sink terminal. For example, in a case where the decoding capability of an audio mixer 133 of the designated sink terminal is lower than that of an audio mixer 133 of the first terminal 100, the audio data may be designated to be decoded in the first terminal 100. Further, for example, in a case where the battery consumption of the first terminal 100 is high for decoding audio data in the first terminal 100, the audio data may be designated to be decoded in the designated sink terminal.

If the audio data is designated to be decoded in the first terminal 100, the audio output path control unit 132 generates a new audio mixer 133 and delivers the audio data to the new audio mixer 133 that has been generated.

The audio mixer 133 decodes and mixes audio data delivered from the audio output path control unit 132 to convert the audio data into an audio. The audio mixer 133 performs decoding using a hardware codec or a software codec. If a codec of audio data to be reproduced is not present, a corresponding software codec may be searched for and downloaded from a server through the data communication unit 110, and the audio data may be decoded using the downloaded codec. The audio mixer 133 may be generated for each terminal connected to the first terminal 100, capable of outputting an audio.

An audio output path determining unit 134 delivers audios to audio drivers 135 corresponding to the output paths thereof. The audio output path determining unit 134 may be included in the audio output path control unit 132, and the audio output path determining unit 134 need not separately be provided.

The audio driver 135 transmits an audio in an output path designated to the audio by the audio output path control unit 132. If the designated output path is a speaker of the first terminal 100, the audio is delivered to the speaker. On the other hand, if the designated output path is the second terminal 200, the audio is transmitted to the second terminal 200 through the data communication unit 110 through a communication system such as the WiDi system.

Hereinafter, a method for controlling an audio output path according to an exemplary embodiment of the present invention will be described in detail with reference to FIGS. 4 to 6.

Figure 4:
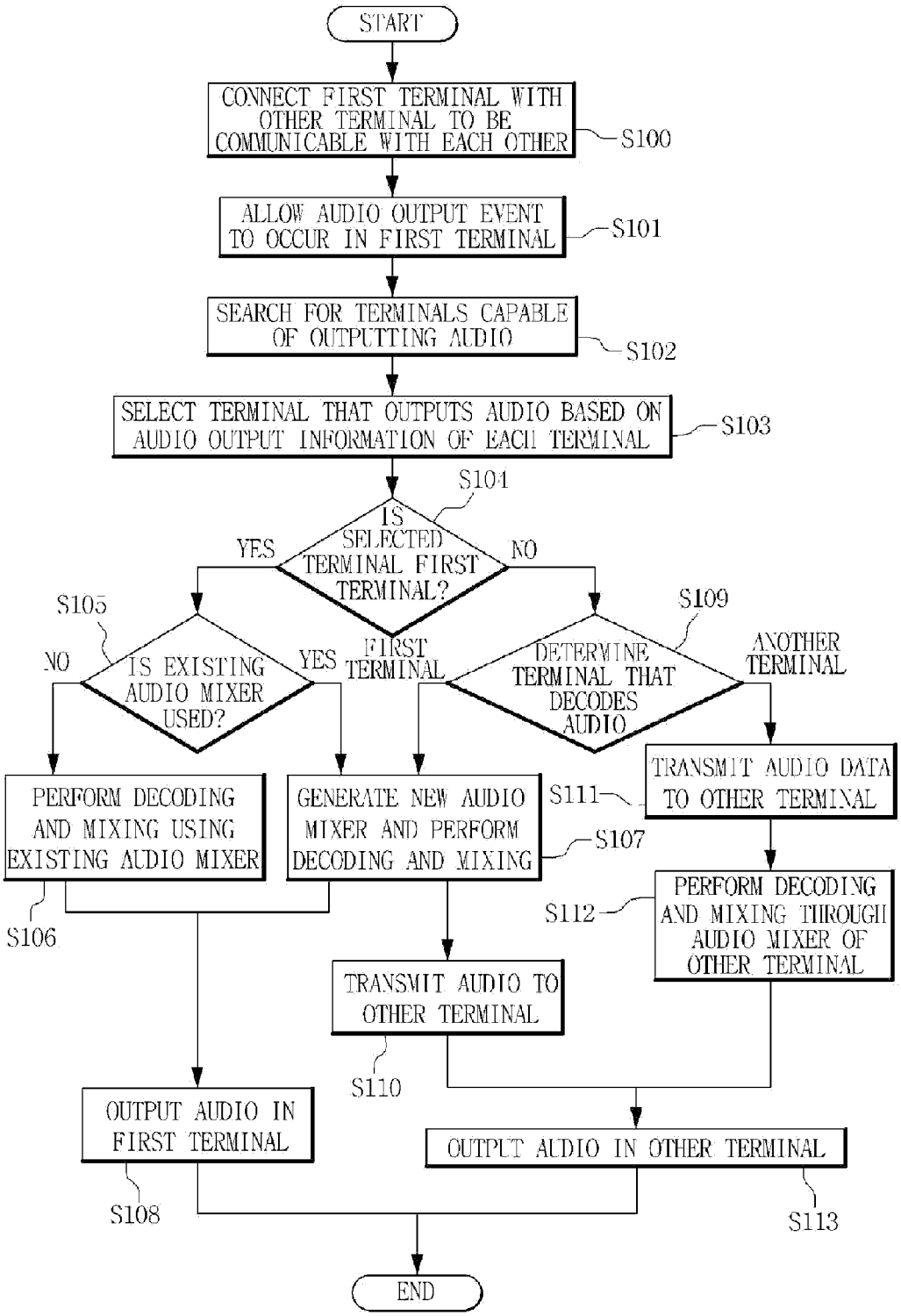
FIG. 4 is a flowchart of a method for controlling an audio output path according to an exemplary embodiment of the present invention.

As illustrated in FIG. 4, S100, initially the first terminal 100 is connected to another terminal, where the two terminals are communicable with each other. For example, the first terminal 100 and the other terminal may be connected, communicable by communication system such as WiDi. In this example, motion picture data, including video data and audio data, of the first terminal 100 may be transmitted to the other terminal through the WiDi system. Meanwhile, since the first terminal 100 may receive data relating to the audio output information of the other terminal through connection with the other terminal, the first terminal 100 may acquire all the information relating to the audio output of the other terminal before an audio output event occurs in the first terminal 100.

After connecting the two terminals, an audio output event may occur in the first terminal 100, as shown in S101. For example, when a user executes a music player or a motion picture player through the first terminal 100, an audio output event may occur. The audio data acquiring unit 131 acquires audio data in accordance with the occurrence of the audio output event.

In S102, The audio output path control unit 132 receives the acquired audio data and searches for terminals capable of outputting audios. The audio output path control unit 132 may search for terminals capable of outputting audios based on the audio output information of the other terminal and the audio output information of the first terminal 100.

Thereafter, in S103, the audio output path control unit 132 selects an audio output path based on the audio output information of each terminal. The selection may be made, for example, according to the two methods as described in detail with reference to FIG. 5 and FIG. 6.

Figure 5:
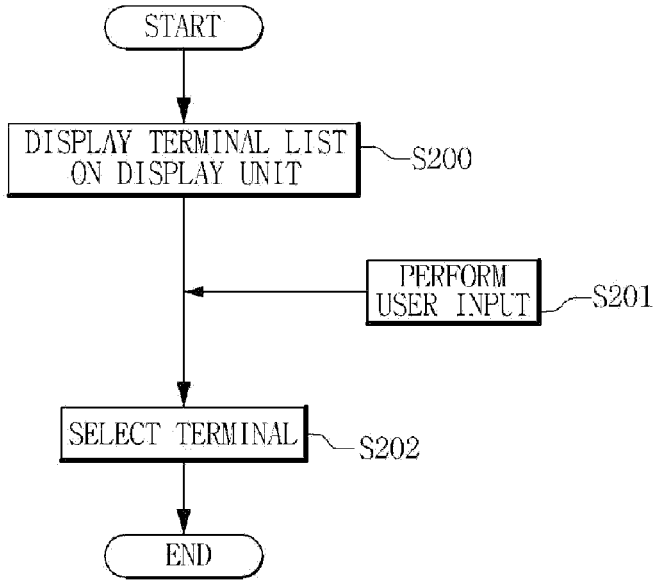
FIGS. 5 and 6 are flowcharts that illustrate methods for controlling an audio output path according to exemplary embodiments of the present invention.

Referring to FIG. 5, the audio output path control unit 132 may select an audio output path in accordance with a user selection.

In S200, the audio output path control unit 132 provides a list of terminals retrieved through a search on the display unit 160 in FIG. 2 and displays the list of terminals through the display unit 160.

In S201, the user selects one terminal based on the audio output states of the terminals in the list, for example, whether the terminals are currently outputting audios. For example, if the first terminal 100 and the second terminal 200 are provided in the list, and a sound relating to a motion picture is reproduced in the second terminal 200, the user selects the first terminal 100.

In S202, the audio output path control unit 132 selects the terminal selected by the user as an audio output path in accordance with the user's selection.

Figure 6:
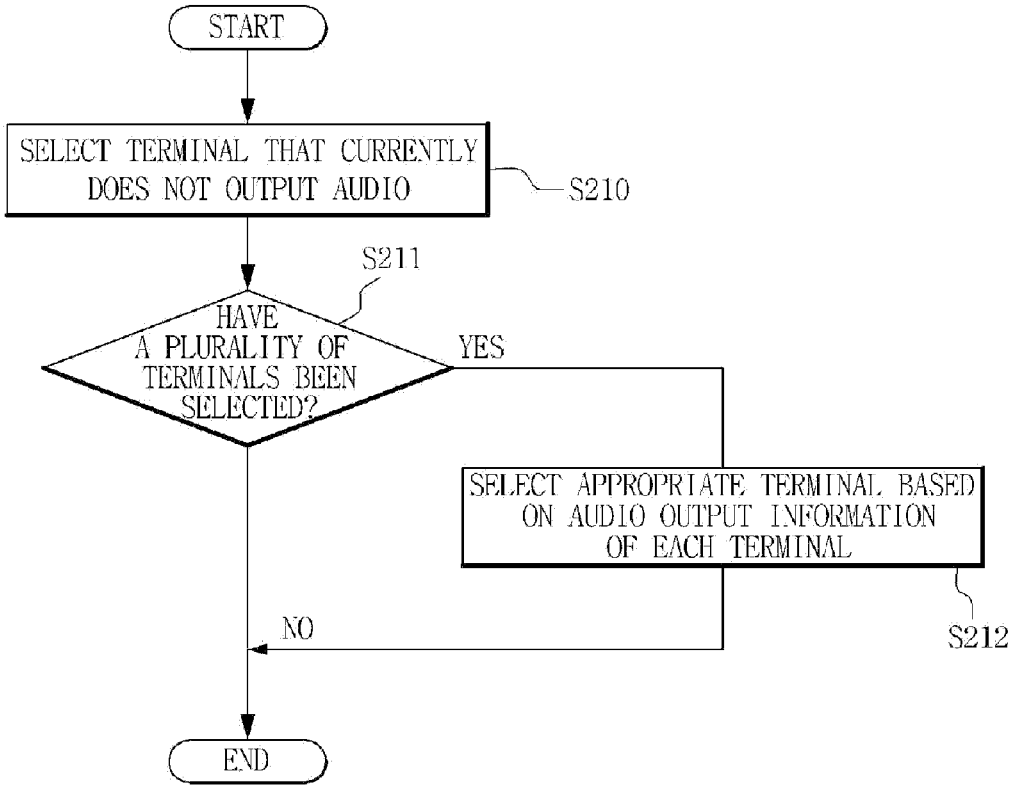

Referring to FIG. 6, alternatively the audio output path control unit 132 in FIG. 3 may automatically select an audio output path by using an internal process.

As shown in S210, the audio output path control unit 132 may select a terminal that does not currently output an audio with high priority. For example, when the second terminal 200 currently outputs an audio in a state in which the first terminal 100 and the second terminal 200 are connected to each other, the automatically selected terminal may be the first terminal 100.

If the audio output path control unit 132 determines two or more terminals that currently do not output any audio, as shown in S211, the audio output path control unit 132 selects an appropriate terminal based on the audio output information of each terminal, as shown in S212.

The audio output information may further include information relating to the type of audio to be output, such as a voice or music in addition to examples described above. For example, among a wireless headphone, a smartphone, and a television set that are connected to be communicable with each other, if the television set and the smartphone currently do not output any audio, generally, an audio/video reproduction device such as the television set has an internal hardware codec built therein, and accordingly, the television set may be selected as an audio output path. In addition, in this example, if the audio output event that has occurred is a phone call reception, the smartphone having a voice input unit may be selected as an audio output path. As such, the audio output path control unit 132 may select an output terminal according hardware of the output terminals. Furthermore, in this example, if the remaining battery capacity of the smartphone is relatively low, the television set may be selected as an audio output path.

In addition, the audio output information may further include information relating to the type of audio output event such as a text message or a phone call reception. For example, among the smartphone and the television set that are connected to be communicable with each other, if the smartphone currently does not output any audio, an event according to external reception may occur. The event according to external reception may be, for example, a passive event appearing in the user's terminal when data transmitted from an arbitrary external terminal is received and may not be an active event that occurs as a user directly executes an application of the smartphone. Examples of events according to external reception include reception of a message, reception of a mail, reception of a phone call, reception of a notification, and the like. For events according to an external reception, the audio may be constantly set to be generated only in the smartphone.

Referring back to FIG. 4, after selecting the terminal to output audio in S103, the audio output path control unit 132 determines whether the selected terminal is the first terminal 100, as shown in S104.

If the first terminal 100 is selected, the audio output path control unit 132 determines whether audio data is currently being decoded using an existing audio mixer in the first terminal 100, as shown in S105.

If an existing audio mixer is not currently being used, audio decoding and mixing are performed through the existing audio mixer, as shown in 5106. An example of an existing audio mixer not being used includes no audio being output in the first terminal 100 or the audio mixing in the second terminal 200 being performed through the audio mixer of the second terminal 200. The audio output path control unit 132 then delivers the audio data to the existing audio mixer, and the existing audio mixer decodes and mixes the audio data to be converted into an audio.

On the other hand, if an existing audio mixer is being used, the audio output path control unit 132 generates a new audio mixer, as shown in S107. Examples where an existing audio mixer is used include the first terminal 100 outputting an audio or an audio mixing of the second terminal 200 being performed through the audio mixer of the first terminal 100. The audio data is then delivered to the new audio mixer and is decoded and mixed to be converted into an audio.

After the conversion, the audio is output to the audio output unit 150 in FIG. 2 of the first terminal 100 through the audio driver 135 in FIG. 3, as shown in 5108.

If a terminal other than the first terminal 100 is selected, the audio output path control unit 132 determines the terminal to decode the audio, as shown in S109. The audio output path control unit 132 determines the terminal to decode the audio based on the audio decoding capabilities of the selected terminal and the first terminal or the audio output information such as the remaining battery state of each terminal.

If it is determined that decoding is being performed in the first terminal 100, the audio output path control unit 132 generates a new audio mixer, as shown in S107. The audio mixer of the first terminal 100 is designed to perform decoding optimized to the output unit, for example, the speaker of the first terminal 100, and accordingly, in order to reproduce an audio through the output unit of the selected terminal, an audio mixer for the selected terminal is necessary. The audio output path control unit 132 delivers audio data to the audio mixer for the selected terminal, and decoding and mixing are performed in the audio mixer for the selected terminal.

In S110, an audio generated through the audio mixer for the selected terminal is transmitted to the selected terminal. For example, if the second terminal 200 is selected to output audio and it is determined that the first terminal 100 will decode the audio data, a new audio mixer corresponding to the second terminal 200 is generated and the audio data converted in the new audio mixer is transmitted to the second terminal 200.

Thereafter, the transmitted audio is output through the output unit of the selected terminal, as shown in S113.

In addition, if it is determined that decoding is performed in the selected device, the audio output path control unit 132 transmits the audio data to the selected terminal, as shown in S111.

Then, the audio data transmitted through the audio mixer of the selected terminal is decoded and mixed to be converted into an audio, as shown in S112.

Thereafter, in S113, the audio is output through the output unit of the selected terminal.

As described above, according to an exemplary embodiment of the present invention, when an audio is output, the audio output path is controlled based on the audio output information of the terminal other than the first terminal, and accordingly, a plurality of audios may be independently reproduced, whereby a user may simultaneously acquire a plurality of different audio information pieces. By providing such an interface, the conventional problem where all audios are output through one audio output unit may be resolved. In addition, by implementing such an interface, the interface is not mixed with the interface of another terminal, whereby a user interface environment matching the needs of various users may be provided.

An example to which an exemplary embodiment of the present invention may be applied will be described with reference to FIGS. 7*a* through 7*e*. In the following example, the first terminal 100 in FIG. 2 may be a mobile terminal 100 and the second terminal 200 in FIG. 2 may be a television set 200. In this example, the mobile terminal 100 and television set 200 may be connected to be communicable with each other through WiDi.

Figure 7A:
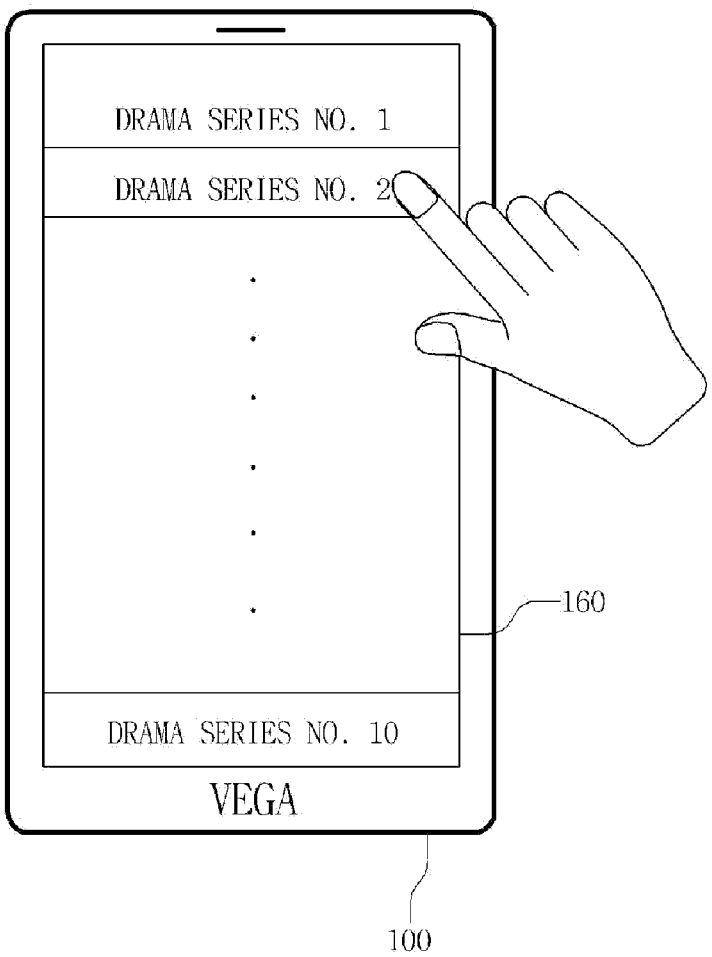
FIGS. 7*a* to 7*e* schematically illustrate an example of the method for controlling an audio output path according to an exemplary embodiment of the present invention.
Figure 7B:
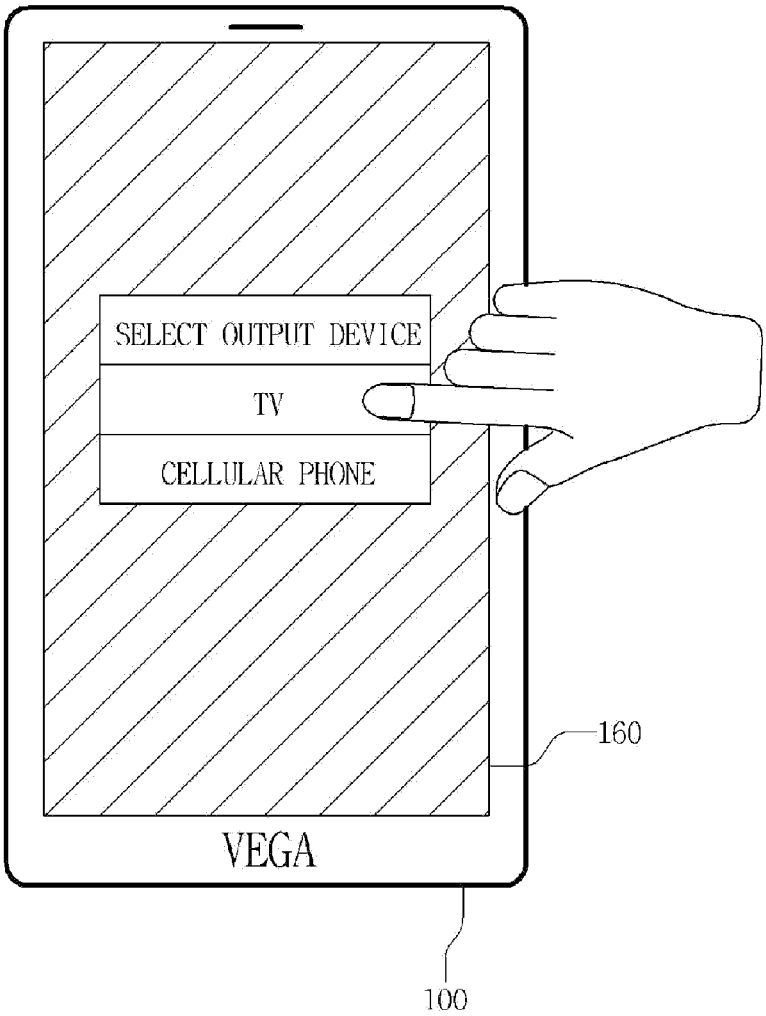
Figure 7C:
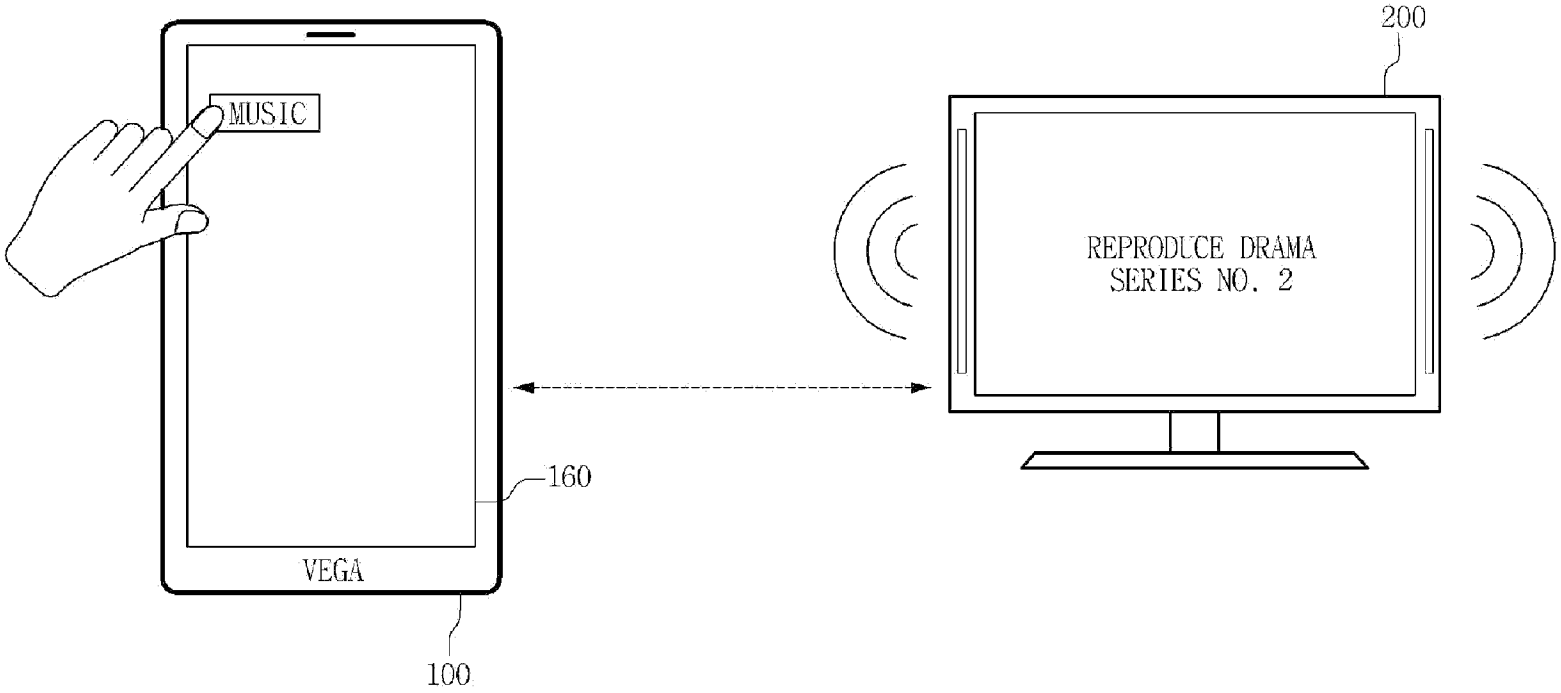

Referring to FIG. 7A, a user selects a motion picture to be viewed through the mobile terminal 100. If a motion picture is to be selected, as illustrated in FIG. 7B, a popup window requesting for a terminal through which the motion picture is to be reproduced is displayed on a display unit 160 of the mobile terminal 100. When the user selects the television set 200, as illustrated in FIG. 7C, a motion picture content stored in the mobile terminal 100 is reproduced through the television set 200. The motion picture content includes video data and first audio data which are transmitted from the mobile terminal 100 to the television set 200, and are reproduced through the screen and the speaker of the television set 200.

While viewing the motion picture on the television set 200, the user may desire to simultaneously listen to music. Accordingly, the user may execute a music application arranged in the mobile terminal 100 as shown in FIG. 7C. In accordance with the execution of the music application, a second audio (music) output event occurs.

Figure 7D:
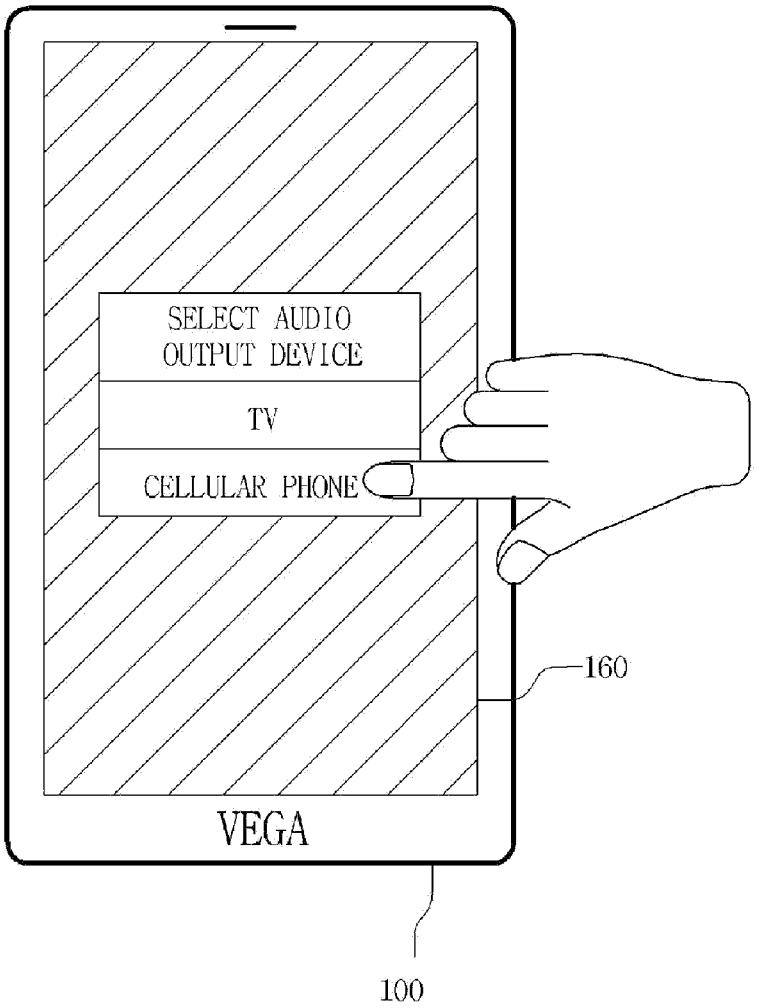

If the second audio output event occurs, as illustrated in FIG. 7D, a popup window requesting for a selection of an audio output device for the second audio is displayed on the mobile terminal 100. In the popup window, the television set 200 and the mobile terminal 100 are displayed together in a list. Because the first audio, the motion picture audio, is being reproduced through the television set 200, the user may select the mobile terminal 100 as a device for outputting the second audio. However, the list of audio output devices may not be provided, and the mobile terminal 100 not reproducing the first audio may be automatically selected as a device for outputting the second audio.

As the mobile terminal 100 is selected as the device for outputting the second audio, the audio output path control unit 132 designates the mobile terminal 100 as the output path of the second audio. If the first audio, motion picture audio, output through the television set 200 is provided through the audio mixer of the mobile terminal 100, the audio output path control unit 132 generates a new audio mixer for the second audio. However, if the first audio on the television set 200 is provided through the audio mixer of the television set 200, the audio mixer of the mobile terminal 100 is used for the second audio.

Figure 7E:
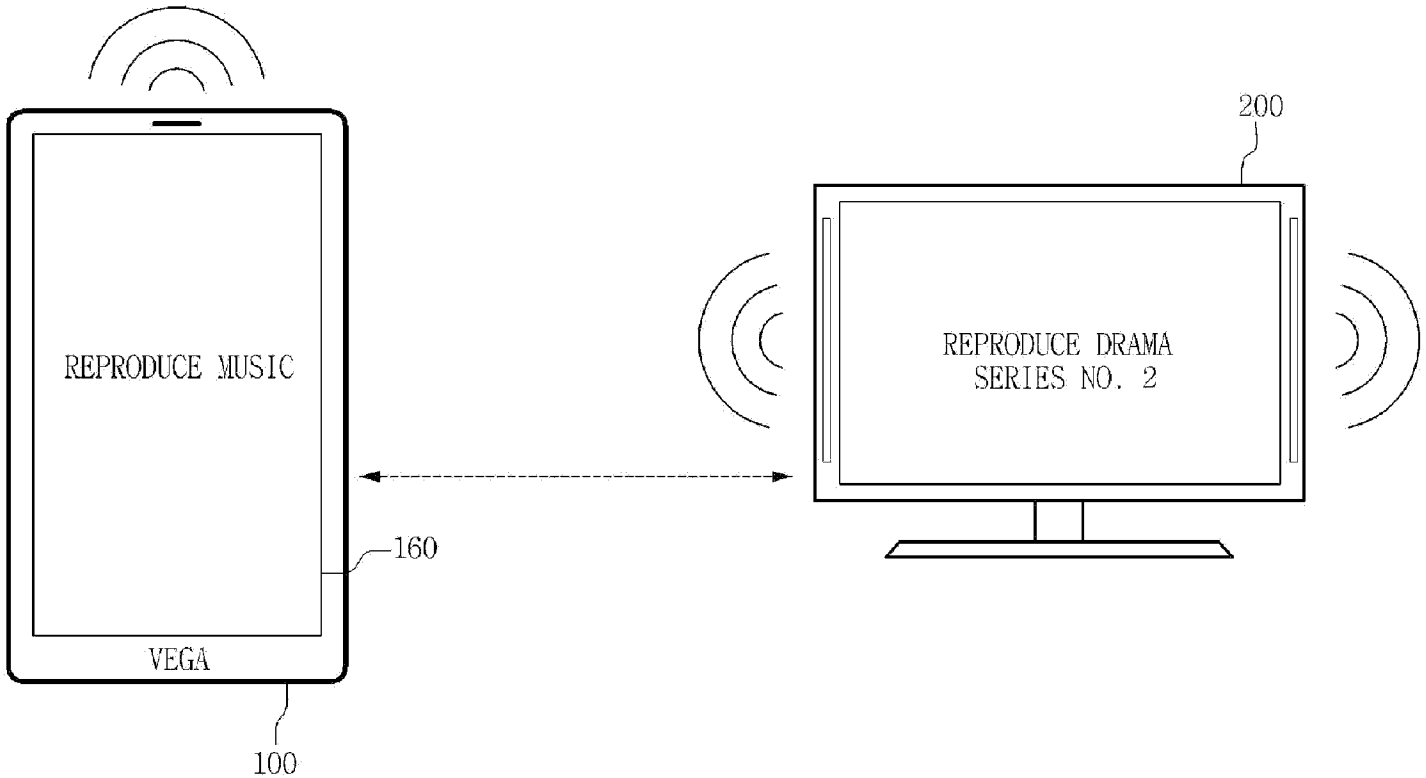

After the second audio data is decoded through an audio mixer that is generated in the mobile terminal 100 or by an existing audio mixer, as illustrated in FIG. 7E, the second audio is output through the speaker of the mobile terminal 100.

In addition, if an audio corresponding to a notification message for an incoming message or the reception of a mail is generated in the mobile terminal 100, if the motion picture audio is output by the television set 200 through WiDi, the user may not select the television set 200 that is reproducing audio, and accordingly, in such a case, the mobile terminal 100 may be designed to automatically output the audio to a terminal which is not outputting audio other than the television set 200 currently reproducing the audio. Further, the audio corresponding to the notification for the incoming message or the reception of a mail or call may be automatically determined to be output by the mobile terminal 100.

Although not illustrated in the figures, in the above-described example, a headset may be additionally connected to the mobile terminal through Bluetooth. In detail, a headset may be additionally connected to the mobile terminal which is also connected to the television set 200 reproducing a motion picture in the mobile terminal.

Under such arrangement, if a phone call reception event occurs, the mobile terminal 100 may provide the headset and the mobile terminal 100 as a list of devices capable of outputting audios. When the user selects the headset, a new audio mixer is generated in the mobile terminal 100. Then, voice data during the phone call is converted into a voice through the new audio mixer, and the voice is transmitted to the headset, whereby the user may receive the phone call through the headset. Further, the headset may be automatically selected to output the audio.

The method for controlling an audio output path according to an exemplary embodiment of the present invention may further include feeding back the state of an audio reproduced in a sink terminal. This process may be performed through the audio feedback unit 170 in FIG. 2 described above.

First, the audio feedback unit 170 detects an output error in the audio output terminal through the data communication unit 110 in FIG. 2. For example, the audio feedback unit 170 may detect that the audio output unit 150 of the sink terminal is broken or an error occurred in the codec of the sink terminal while the sink terminal is set as an audio output path.

Then, the audio feedback unit 170 transmits the error information to the audio processing unit 130 or the audio output path control unit 132 in FIG. 2.

The audio processing unit 130 or the audio output path control unit 132 that has received the error information may set a terminal other than the terminal in which the error occurred as an audio output path. Further, selection of terminal may be made through S103 in FIG. 4 described above.

As described above, according to an exemplary embodiment of the present disclosure, by including a feedback function for the audio output state, the problem of an error occurring during audio output may be solved without user intervention and improve user convenience.

The exemplary embodiments according to the present invention may be recorded in non-transitory computer-readable media including program instructions to implement various operations embodied by a computer. The media may also include, alone or in combination with the program instructions, data files, data structures, and the like. The media and program instructions may be those specially designed and constructed for the purposes of the present invention, or they may be of the kind well-known and available to those having skill in the computer software arts. Examples of non-transitory computer-readable media include magnetic media such as hard disks, floppy disks, and magnetic tape; optical media such as CD ROM disks and DVD; magneto-optical media such as floptical disks; and hardware devices that are specially configured to store and perform program instructions, such as read-only memory (ROM), random access memory (RAM), flash memory, and the like. Examples of program instructions include both machine code, such as produced by a compiler, and files containing higher level code that may be executed by the computer using an interpreter. The described hardware devices may be configured to act as one or more software modules in order to perform the operations of the above-described embodiments of the present invention.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A source terminal to control an audio output path, the source terminal comprising:

a processor configured with processor-executable instructions to:

execute events comprising audio data;

acquire a first audio data and a second audio data, the first audio data being different from the second audio data;

select a first terminal and a second terminal from the source terminal and one or more sink terminals connected to the source terminal to simultaneously output the first audio data and the second audio data, respectively; and set a first audio output path to output the first audio data and a second audio output path to output the second audio data, wherein the first audio data is delivered in the first audio output path to the first terminal, and the second audio data is delivered in the second audio output path to the second terminal, and wherein the first audio output path and the second audio output path are set based on audio output information comprising a type of an audio codec of the source terminal and the one or more sink terminals and a priority level.

2. The source terminal of claim 1, further comprising:

a display unit to display a list comprising the source terminal and the one or more sink terminals connected to the source terminal available to output a first audio and a second audio corresponding to the first audio data and the second audio data, respectively, according to the events.

3. The source terminal of claim 2, wherein the processor is configured with processor-executable instructions to set the first audio output path and the second audio output path according to a user selection from the displayed list.

4. The source terminal of claim 2, wherein the processor is configured with processor-executable instructions to indicate occurrence of an error in output of the audio, wherein the audio output path is set in response to receipt of the error.

5. The source terminal of claim 2, wherein if the source terminal is set to output the first audio, the first audio data is decoded in an audio mixer of the source terminal when the audio mixer is not being used.

6. The source terminal of claim 5, wherein if the source terminal is set to output the first audio, a second audio mixer is generated to decode the first audio data when the audio mixer is being used.

7. The source terminal of claim 6, wherein if the sink terminal is set to output the second audio, the second audio mixer decodes the second audio data if decoding occurs in the source terminal and an audio mixer of the sink terminal decodes the second audio data if decoding occurs in the sink terminal.

8. The source terminal of claim 1, wherein the audio output information comprises at least one of an audio output status, an audio codec type, an audio output performance ability, an audio output event type, and an audio type.

9. A method for controlling an audio output path, the method comprising:

executing events comprising audio data;

acquiring a first audio data and a second audio data, the first audio data being different from the second audio data;

selecting a first terminal and a second terminal from a source terminal and one or more sink terminals connected to the source terminal to simultaneously output the first audio data and the second audio data, respectively; and setting a first audio output path to output the first audio data to the first terminal and a second audio output path to output the second audio data to the second terminal, the second audio output path being different from the first audio output path, wherein the first audio output path and the second audio output path are set based on audio output information comprising a type of an audio codec of the source terminal and the one or more sink terminals and a priority level.

10. The method of claim 9, further comprising displaying a list comprising the source terminal and the one or more sink terminals connected to the source terminal available to output a first audio and a second audio corresponding to the first audio data and the second audio data, respectively.

11. The method of claim 10, wherein the audio output path is set according to a user selection from the displayed list.

12. The method of claim 10, further comprising indicating occurrence of an error in output of audio, wherein the audio output path is set in response to receipt of the error.

13. The method of claim 10, further comprising decoding the first audio data in an audio mixer of the source terminal, if the source terminal is set to output the first audio and the audio mixer is not being used.

14. The method of claim 13, further comprising generating a second audio mixer to decode the first audio data if the source terminal is set to output the first audio and the audio mixer is being used.

15. The method of claim 10, further comprising decoding the second audio data in an audio mixer of the sink terminal, if the sink terminal is set to output the second audio.

16. A source terminal to control an audio output path, the source terminal comprising:

a processor configured with processor-executable instructions to:

execute events comprising audio data;

acquire a first audio data and a second audio data, the first audio data being different from the second audio data;

select a first terminal and a second terminal from the source terminal and one or more sink terminals connected to the source terminal to simultaneously output a first audio and a second audio corresponding to the first audio data and the second audio data, respectively; and set a first audio output path and a second audio output path for the first audio data and the second audio data to be delivered to the selected first and second terminals, wherein the first audio output path and the second audio output path are set based on audio output information comprising a type of an audio codec of the source terminal and the one or more sink terminals and a priority level.

* * * * *